US010582811B2

(12) United States Patent
Teague

(10) Patent No.: US 10,582,811 B2
(45) Date of Patent: Mar. 10, 2020

(54) VENTILATED LEAK-PROOF CONTAINER

(71) Applicant: Terrell Kirtpatrick Teague, Fairport, NY (US)

(72) Inventor: Terrell Kirtpatrick Teague, Fairport, NY (US)

(73) Assignee: Terrell K. Teague, Fairport, NY (US)

( * ) Notice: Subject to any disclaimer, the term of this patent is extended or adjusted under 35 U.S.C. 154(b) by 0 days.

(21) Appl. No.: 16/172,760

(22) Filed: Oct. 27, 2018

(65) Prior Publication Data

US 2019/0142226 A1 May 16, 2019

Related U.S. Application Data

(60) Provisional application No. 62/707,714, filed on Nov. 15, 2017, provisional application No. 62/709,041, filed on Jan. 5, 2018.

(51) Int. Cl.

| | |
|---|---|
| ***A47K 5/03*** | (2006.01) |
| ***A47K 5/05*** | (2006.01) |
| ***B65D 5/42*** | (2006.01) |
| *B65D 43/16* | (2006.01) |
| *B65D 5/10* | (2006.01) |

(52) U.S. Cl.

CPC ..... *A47K 5/03* (2013.01); *A47K 5/05* (2013.01); *B65D 5/4279* (2013.01); *B65D 5/10* (2013.01); *B65D 43/162* (2013.01)

(58) Field of Classification Search

CPC ..... B65D 5/4279; B65D 5/42; B65D 5/10; B65D 25/108; B65D 25/10; B65D 81/3294; A47K 5/02–5; A47D 40/00; A47D 40/22

USPC .... 206/77.1, 823, 1; 220/694, 745, 747, 748

See application file for complete search history.

(56) References Cited

U.S. PATENT DOCUMENTS

| | | | | |
|---|---|---|---|---|
| 3,688,895 A * | 9/1972 | Wilson | A45D 40/221 206/37 |
| 4,754,874 A * | 7/1988 | Haney | A47K 5/02 132/286 |
| 5,941,376 A * | 8/1999 | Liggett | A47K 5/02 206/550 |
| 7,524,230 B2 * | 4/2009 | Thai | A63H 33/28 446/15 |
| 7,942,109 B2 * | 5/2011 | Schramm | A63H 33/28 118/13 |
| 8,960,430 B2 * | 2/2015 | Roach | A45C 5/03 206/363 |

* cited by examiner

*Primary Examiner* — J. Gregory Pickett
*Assistant Examiner* — Tia Cox

(57) ABSTRACT

A container used to hold and transport items that get wet during use such as bar soap, razors, toothbrushes and clothing. Ducts in the container allow drier air from outside the container to mix with moist air inside the container to aid in the drying process. The ducts protrude into the container such that the openings in the ducts are presented above the level of any liquid dripping from the wet items regardless of the container's orientation. Thus, retaining the relatively small amount of liquid droplets and providing ventilation for drying. An embodiment can also arrange the position of the ducts to aid in the retention of the contained items to limit the movement of contents during transport.

4 Claims, 14 Drawing Sheets

VENTILATED LEAK-PROOF CONTAINER

CROSS-REFERENCE TO RELATED APPLICATIONS

This application claims the benefit of provisional patent application Ser. No. 62/707,714 filed 2017 Nov. 15 and Ser. No. 62/709,041 filed 2018 Jan. 5 by the present inventor.

BACKGROUND—PRIOR ART

The following is a tabulation of some prior art that presently appears relevant:

| U.S. patents | | | |
|---|---|---|---|
| Pat. No. | Kind Code | Issue Date | Patentee |
| 7,726,471 | B2 | 2010 Jun. 1 | S. R. Srungaram |
| 5,941,376 | A | 1999 Aug. 24 | James R. Liggett |
| **U.S. patent application** | | | |
| Pub No. | Kind Code | Publ. Date | Applicant |
| 20180049600 | A1 | 2018 Feb. 22 | Tijuana Smith |
| **Foreign Patents** | | | |
| Country | Patent Number | Issue Date | |
| CN | CN203943597U | 2014 Nov. 19 | |
| CN | CN201719150U | 2011 Jan. 26 | |

At present time it is common practice to transport items that would normally get wet during normal use in sealed containers or containers that feature drain holes. Common examples of these items include soap bars, toothbrushes, razors, dental retainers and wet clothing. In practice the user of such items would use the item and, in many cases, need to transport it before it has a chance to dry. An example is in my own experience of using bar soap for showering at the gym. After showering, the bar soap used in the shower is placed in a container and packed up with other shower items to be taken with me upon leaving the gym. The bar soap is still wet when it's put into a container for transportation.

The prior art for transporting such items generally consists of a container that has a top and bottom section that is hinged or snapped together that allows the contents to be loaded, then closed to secure those items. Prior art containers are generally either liquid tight when closed or with holes that act like drains or vents to allow liquid to drain and air flow to dry the contents.

In the case where the container is liquid tight, the liquid from the items does not leak out, however, the moisture inside the container is trapped and the contents do not dry properly. Prior art examples such as Chinese Patent Number CN203943597U trap in moisture when closed not allowing wet items to dry. The design of U.S. Pat. No. 7,726,471 provides for a drying rack when the wet item is in use, but when the item is stored, any wetness would be trapped inside. Prior art examples such as these are designed to seal in as much liquid as the case will hold. Which, in the application of transporting wet items, the amount of liquid dripping off the item is relatively small as compared to the size of the item and current prior art does not take advantage of that situation.

In contrast to containers that seal in moisture, other prior art designs provide holes for liquid to drain and provide air flow for drying, such as prior art in U.S. Pat. No. 5,941,376, U.S. Patent Application 20180049600 and Chinese Patent CN201719150U. The problem with these designs is that if there is any liquid from the wet contents, it can leak from the container and cause a mess.

In my search of prior art, I have not found any device that allows for air flow to dry wet items and also prevent liquid from wet items leaking.

SUMMARY

In accordance with one embodiment a container with ducts that extend from the container exterior in to the container interior. The ducts allow for outside air to mix with the moist air inside the container which aids in drying the items. The ducts also position the interior openings in such a way to trap liquid from the wet items.

DRAWINGS—FIGURES

In the drawings, closely related figures have the same number but different alphabetic suffixes.

REFERENCE NUMERALS

| | | | |
|---|---|---|---|
| 100 | First embodiment container | 102 | Body |
| 104 | Access cover | 106 | Interior opening |
| 108 | Duct | 110 | Sealing surface |
| 112 | Hinge | 114 | Rib |
| 116 | Latch tongue | 202 | Bar soap |
| 306 | Exterior opening | 602 | Liquid |
| 1100 | Second embodiment container | 1500 | Third embodiment container |
| 1506 | Round soap | 1602 | Spring-loaded retainer |

DETAILED DESCRIPTION

First Embodiment: FIG. 1-FIG. 6

Figure 1:
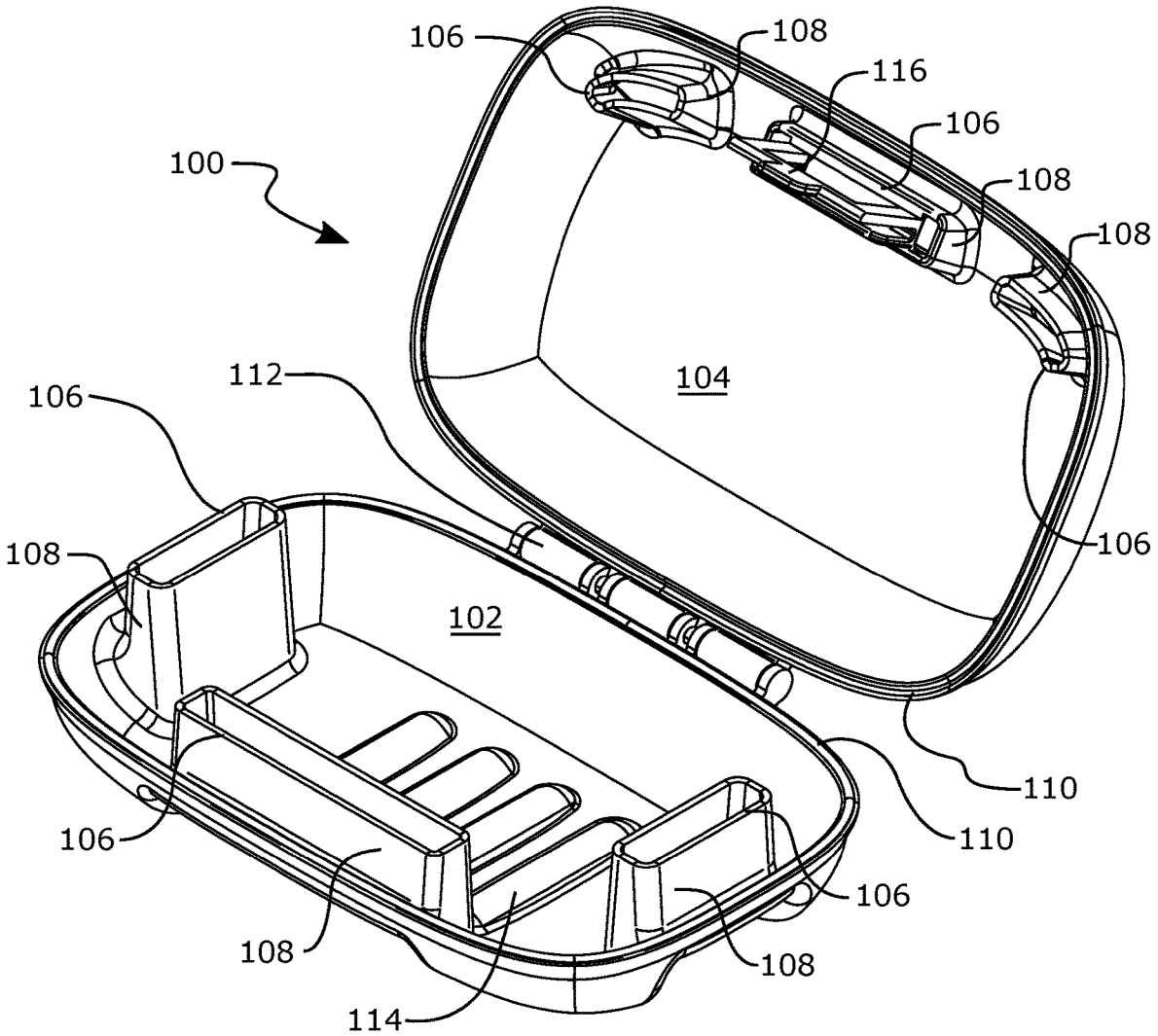
FIG. 1 shows an isometric view from the top of the first embodiment with its access cover open.
Figure 2:
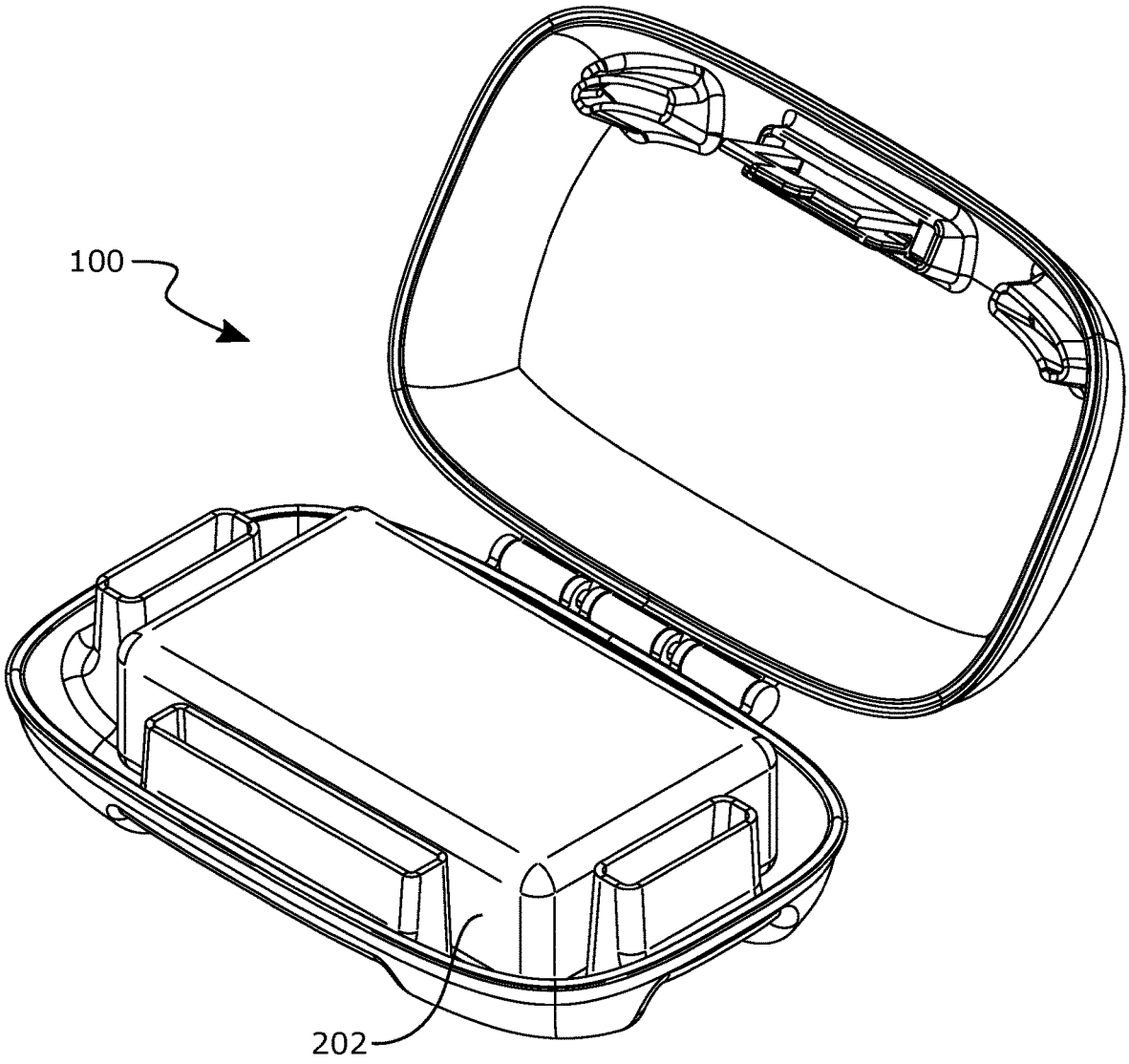
FIG. 2 shows an isometric view from the top of the first embodiment with its access cover open and a bar of soap for reference.
Figure 3:
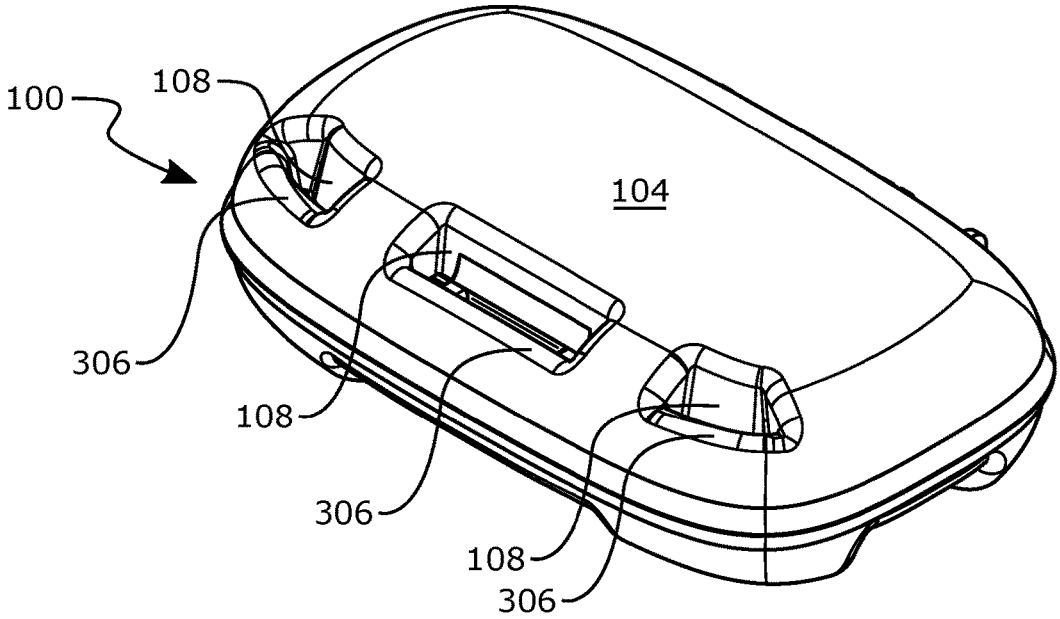
FIG. 3 shows an isometric view from the top of the first embodiment with its access cover closed.
Figure 4:
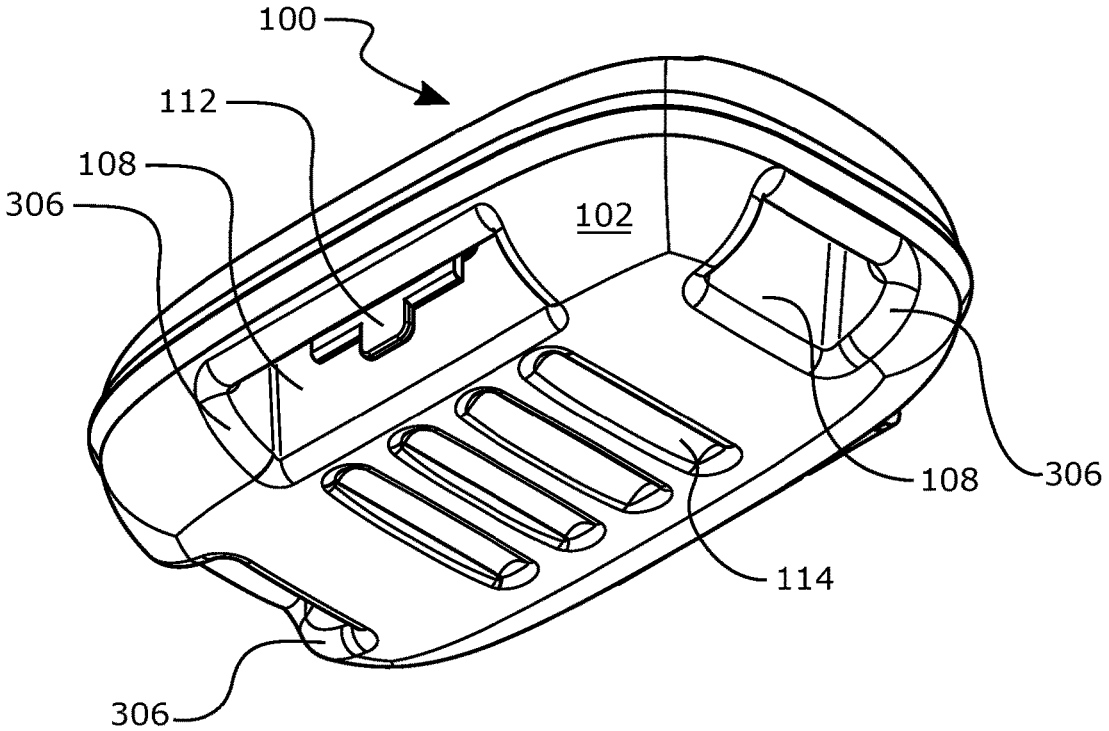
FIG. 4 shows an isometric view from the bottom of the first embodiment with its access cover closed.
Figure 5:
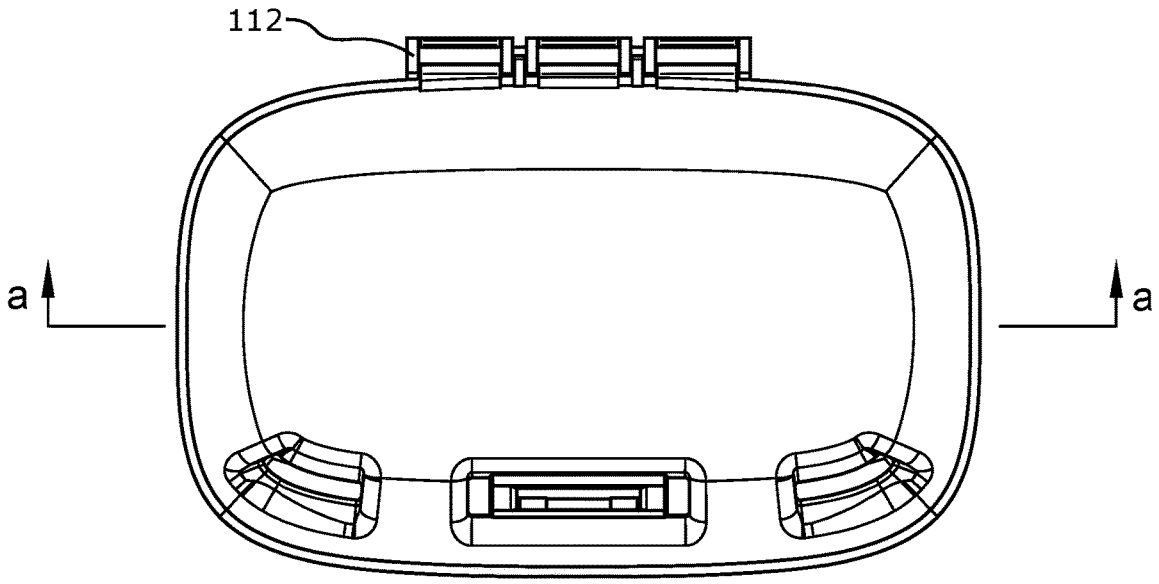
FIG. 5 shows a top view of the first embodiment with its access cover closed and sectional line aa.
Figure 6:
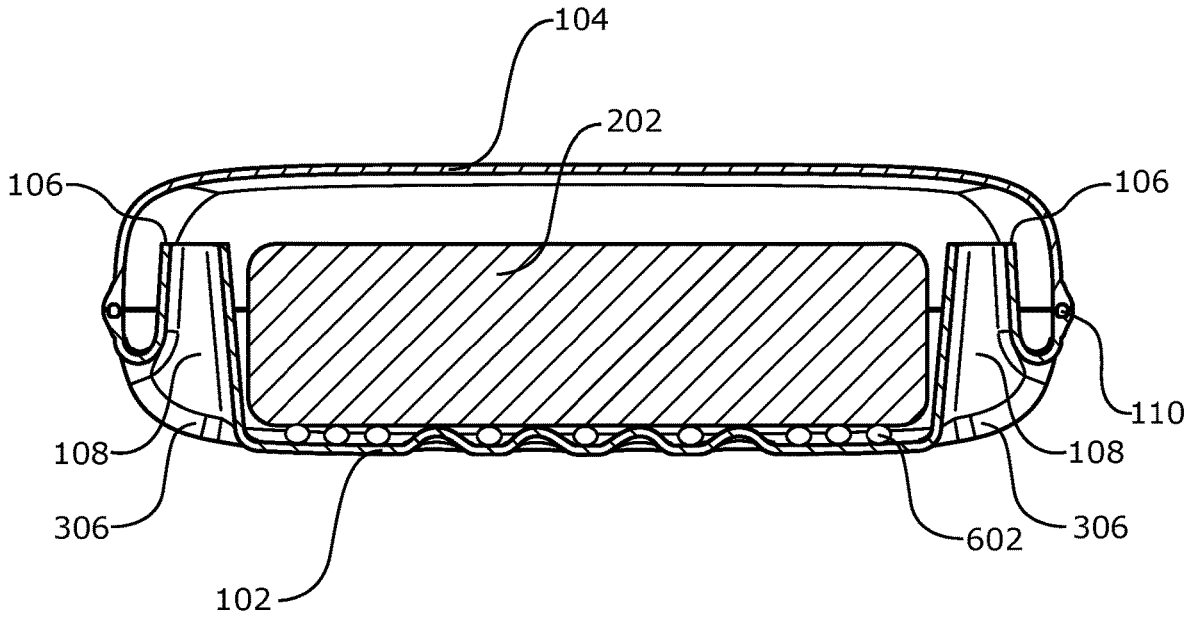
FIG. 6 is the cross-sectional view of section aa which includes a bar of soap for reference and liquid droplets.
Figure 7:
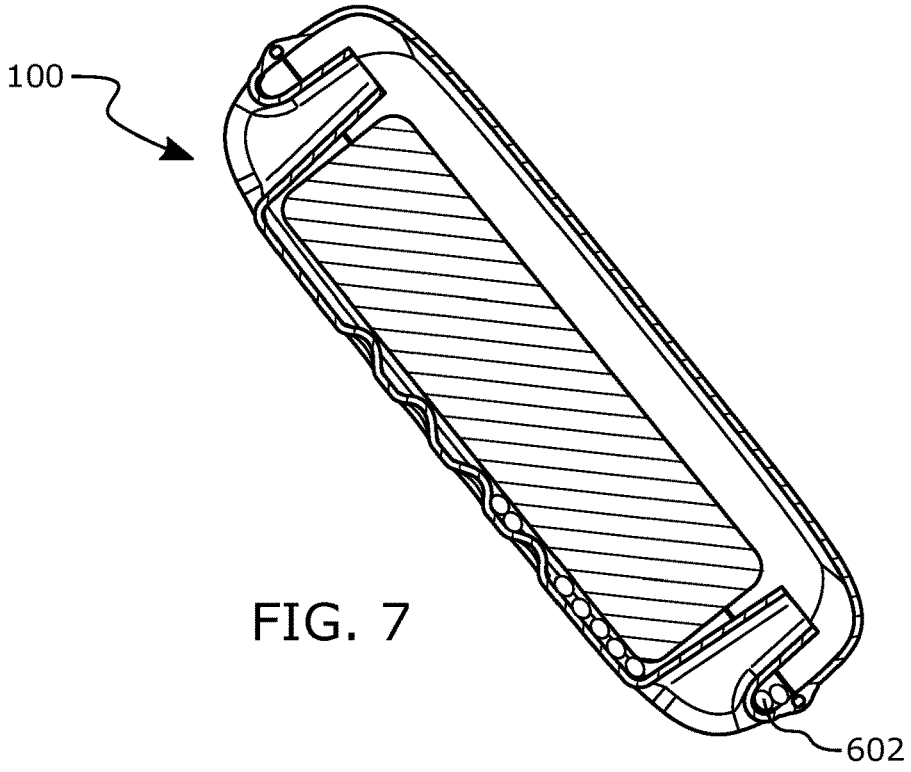
FIG. 7 is the same as FIG. 6 but tilted at 45 degrees.
Figure 8:
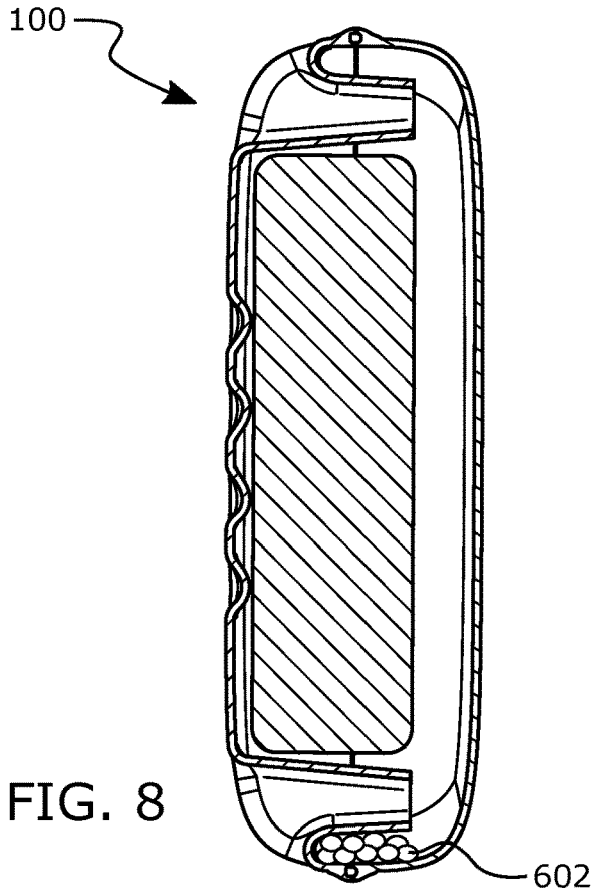
FIG. 8 is the same as FIG. 6 but tilted at 90 degrees.
Figure 9:
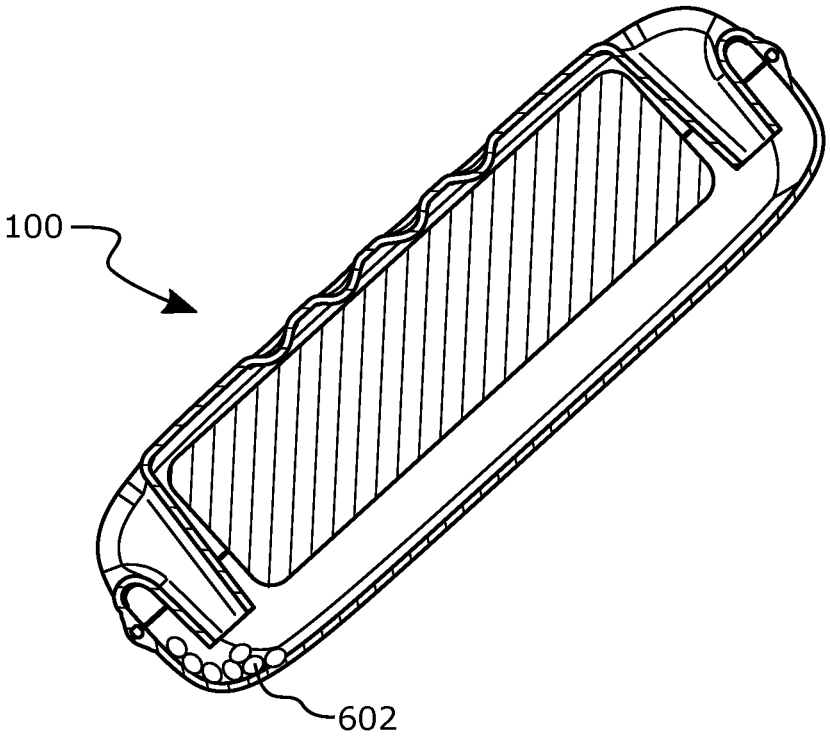
FIG. 9 is the same as FIG. 6 but tilted at 135 degrees.
Figure 10:
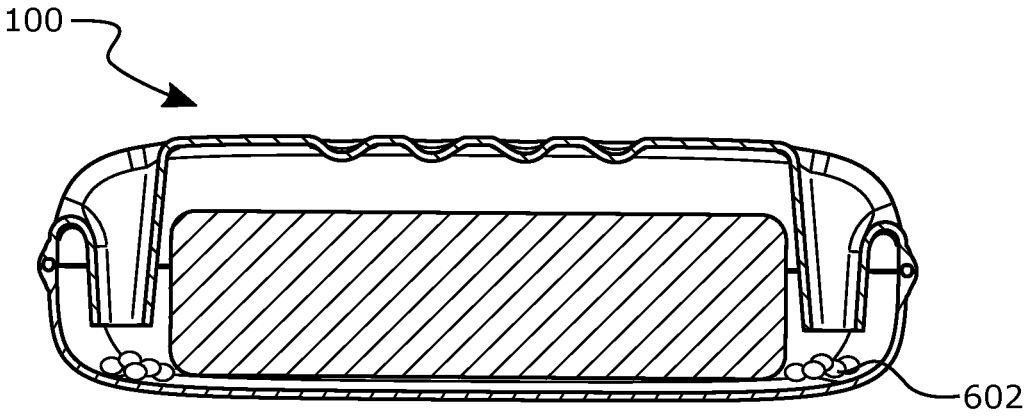
FIG. 10 is the same as FIG. 6 but tilted at 180 degrees.

This first embodiment container 100 is constructed of a body 102 and an access cover 104 and connected by a hinge 112. FIG. 1 illustrates this arrangement showing container 100 in the open state. Ducts 108 extend from the exterior of body 102 toward the interior. Likewise, ducts 108 extend from the exterior of access cover 104 to the interior. The interior openings 106 are positioned in such a way to trap liquid between the opening and the interior when container 100 is in the closed state. The ducts 108 and interior openings 106 are positioned to allow room for contents to be placed inside of container 100. FIG. 2 illustrates this by showing a bar of soap 202 for reference. FIG. 3 and FIG. 4 show container 100 in the closed state and illustrate how the exterior openings 306 terminate on the exterior of the body 102 and access cover 104. A sealing surface 110 on the rim of the body 102 and the access cover 104 prevents leakage between the body 102 and access cover 104 when they are closed together. A latch tongue 116 connected to the access cover 104 latches to the body 102 when closed to keep the body 102 and access cover 104 together in the closed state. FIG. 5 shows a top view and cross-sectional line aa used for the cross-sectional view in FIG. 6. FIG. 6 illustrates how liquid 602 collects in the body 102 due to gravity. FIG. 6 also illustrates how a vent path is established by the exterior opening 306, duct 108 and interior opening 106. In the case where a wet item such as a bar of soap is placed inside and the access cover 104 is closed, this vent path allows dry air from outside to mix with the moist air inside. The mixing will allow the item inside to dry faster than if there were no vent path. It can also be seen in FIG. 6 that in this position the liquid 602 is trapped. Ribs 114 present a surface with peaks and valleys to elevate the soap 202 when container 100 is in this position so that some amount of liquid 602 can be present but not in contact with the soap 602. Ribs 114 also allow for some amount of air to reach the underside of soap 202 to further aid in the drying process.

It should also be noted that if duct 108 had a trough like feature along its path and an interior opening 106 were placed on the low point of this trough feature, liquid 602 could possibly be diverted to interior opening 106 and leak out. Therefore, duct 108 has to have at least one surface that is either flat or out-curved in shape to divert any liquid 602 away from an interior opening 106 placed on that surface. Duct 108 surfaces that have a trough like or in-curved profile along the path of duct 108 can not have any interior openings 106.

Operation—First Embodiment: FIG. 7-FIG. 10

FIG. 7 through FIG. 10 illustrates how some amount of residual liquid 602 is trapped inside at any angle container 100 is positioned in. Liquid 602 is directed away from the interior openings 106 and therefore does not leak out. This applies to any angle in any axis. FIG. 7 through FIG. 10 also illustrates how the duct 108 also aids in retaining the position of soap 202.

Second Embodiment: FIG. 11-FIG. 14

Figure 11:
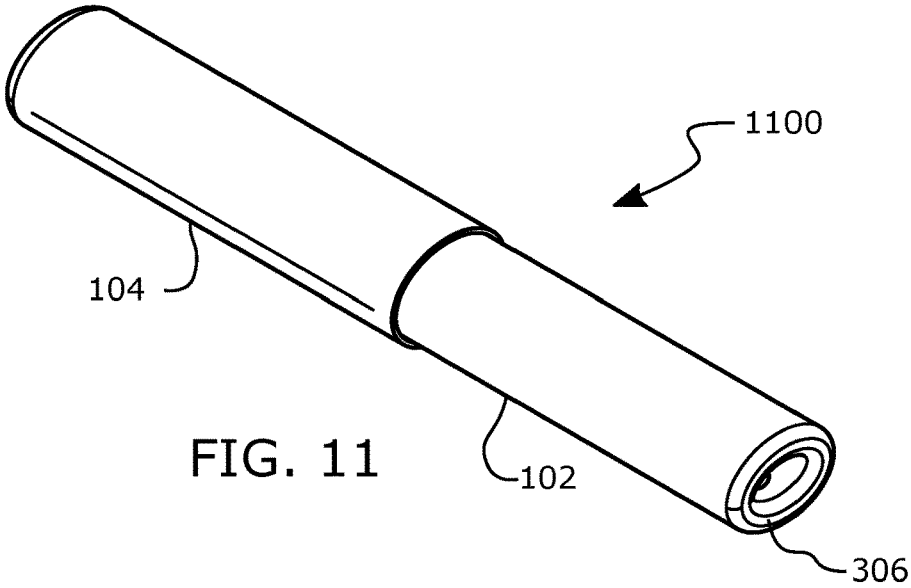
FIG. 11 shows an isometric view from the top of a second embodiment.
Figure 12:
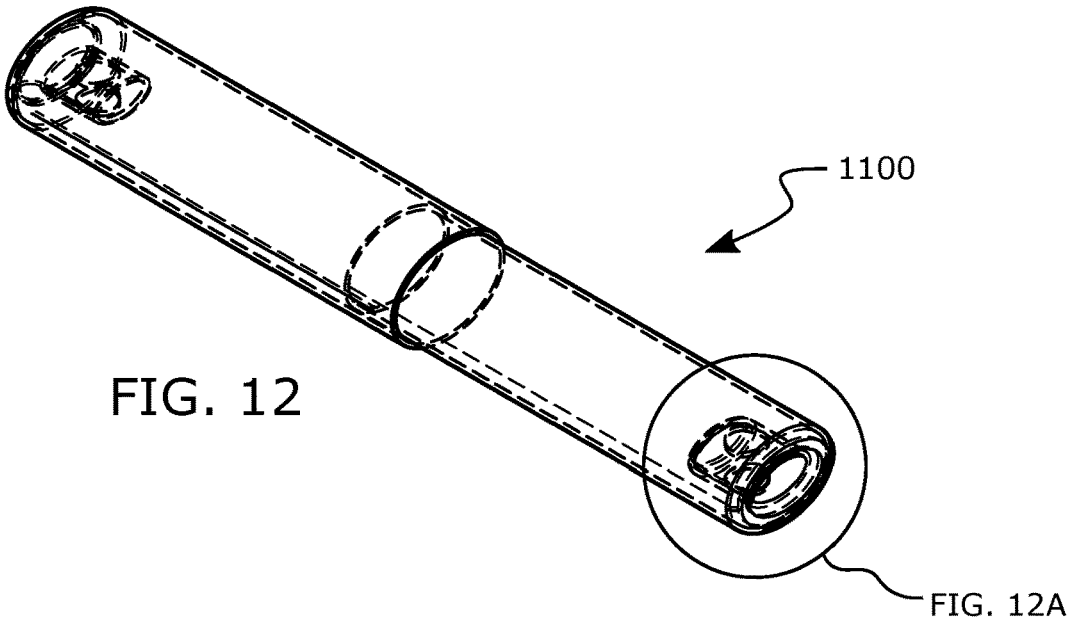
FIG. 12 shows an isometric view from the top of a second embodiment and hidden lines to show construction.
Figure 12A:
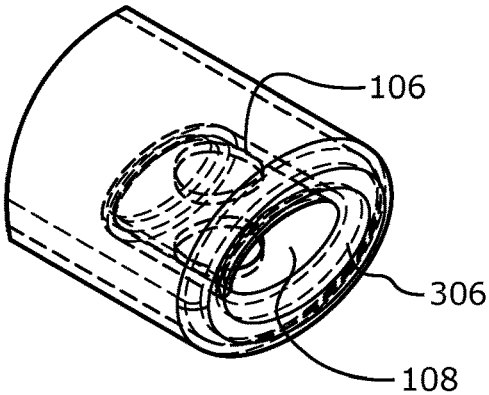
FIG. 12A shows detail of FIG. 12.
Figure 13:
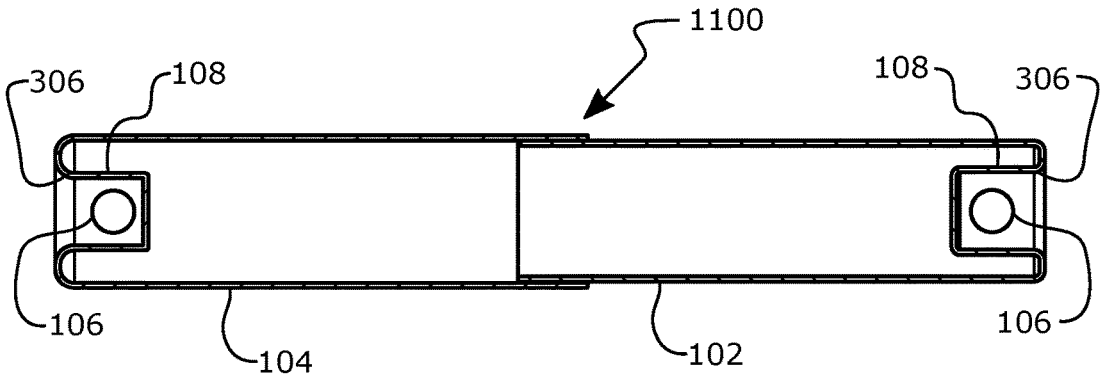
FIG. 13 shows a cross-sectional view of the second embodiment.
Figure 14:
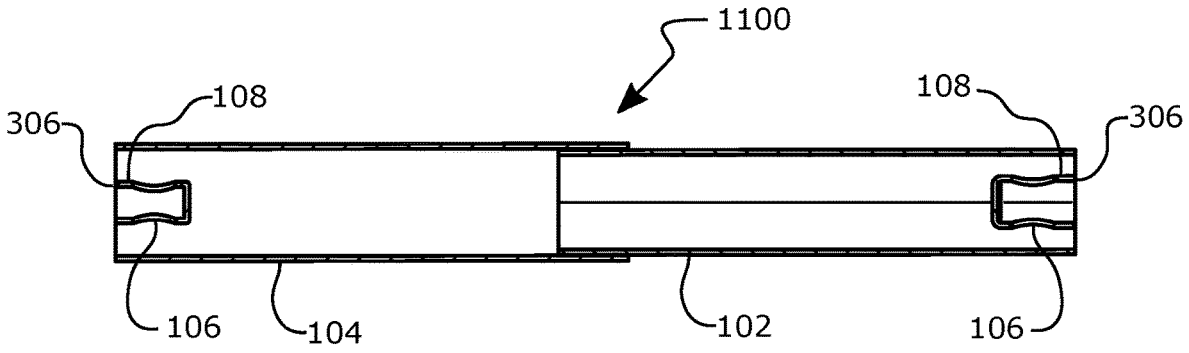
FIG. 14 shows a cross-sectional view of the second embodiment but rotated 90 degrees to show interior opening from a different angle.

FIG. 11 illustrates a second embodiment container 1100. In this embodiment the access cover 104 slides partially on to body 102 with a fit close enough to provide a liquid tight seal. The hidden lines of FIG. 12 show the interior construction of container 1100. FIG. 12A shows a detailed view of how the interior opening 106, duct 108 and exterior opening 306 are constructed. Container 1100 differs from container 100 in that there are 2 interior openings 106 for each duct 108. Referring to FIG. 13 and FIG. 14 it can also be seen that the interior opening 106 is not a straight path from the exterior opening 306. In this embodiment, the plane of interior opening 106 is angled approximately 90 degrees from the plane of exterior opening 306. However, since the interior opening 106 is some distance away from the inside wall of container 1100 and the duct 108 has a convex shape along its path, liquid 602 is diverted from the interior opening 106 in any angle container 1100 is placed in. A toothbrush holder would be an example of when the arrangement of container 1100 would be useful. A toothbrush placed inside would be retained between the 2 ducts 108 since the portion of duct 108 next to the toothbrush would be closed off.

Operation—Second Embodiment

In this embodiment, container 1100 is opened by pulling access cover 102 from body 104. This allows access to place items inside. To close the container 1100, the access cover 104 is slid on to body 102. As in the same manner as container 100 liquid droplets from the item would be trapped inside at any angle container 1100 was placed in. The interior will also be vented in the same manner as container 100.

Third Embodiment: FIG. 15-FIG. 18

Figure 15:
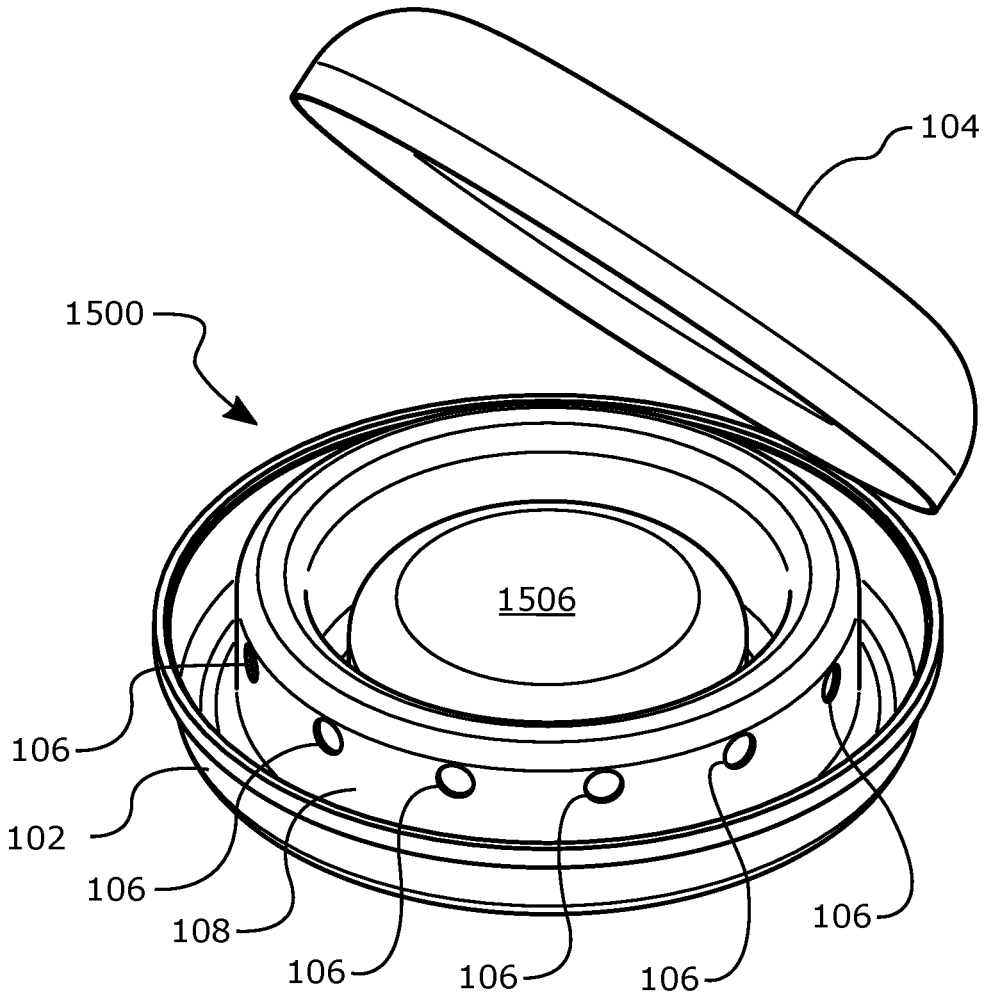
FIG. 15 shows an isometric view from the top of a third embodiment with its access cover open.
Figure 16:
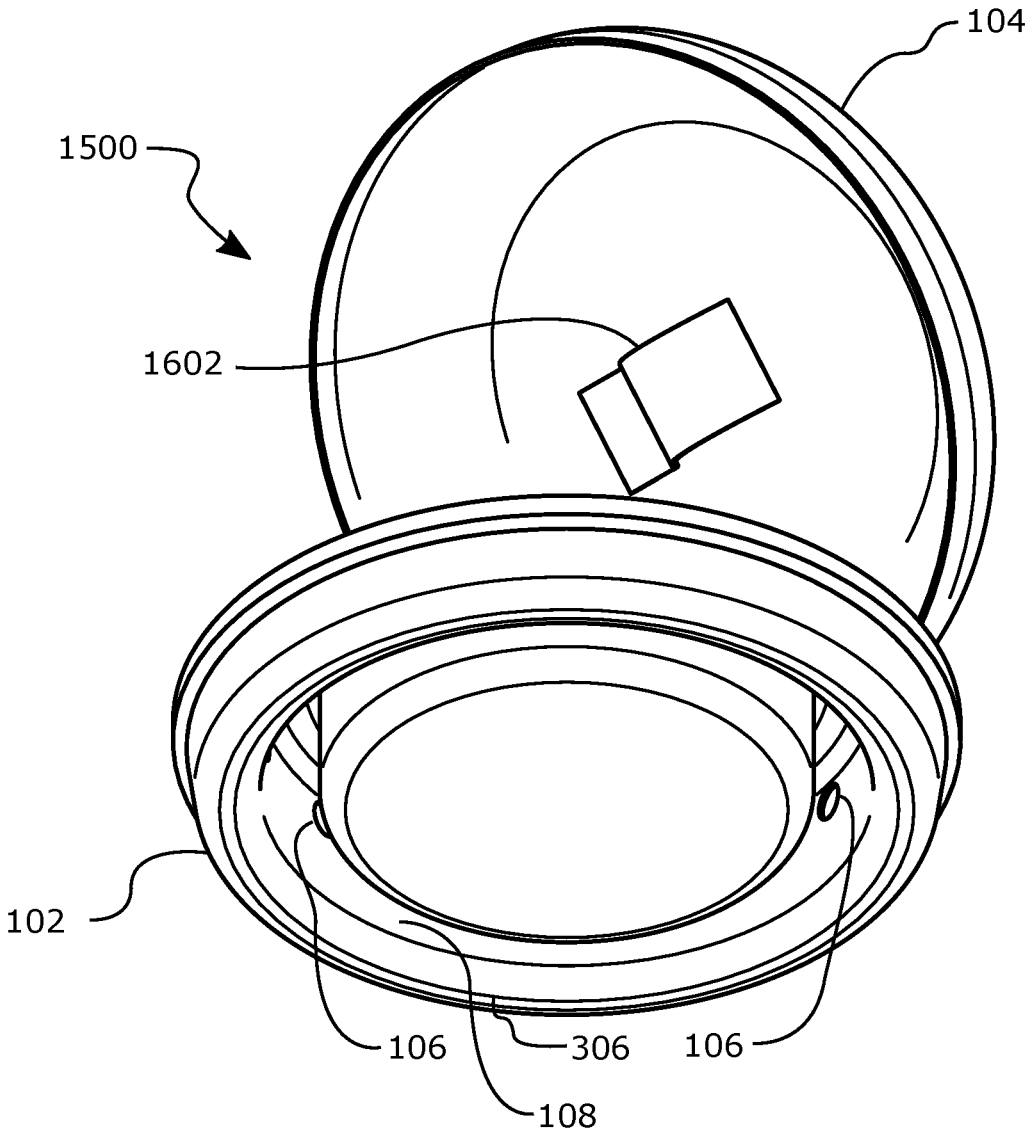
FIG. 16 shows an isometric view from the bottom of a third embodiment with its access cover open.
Figure 17:
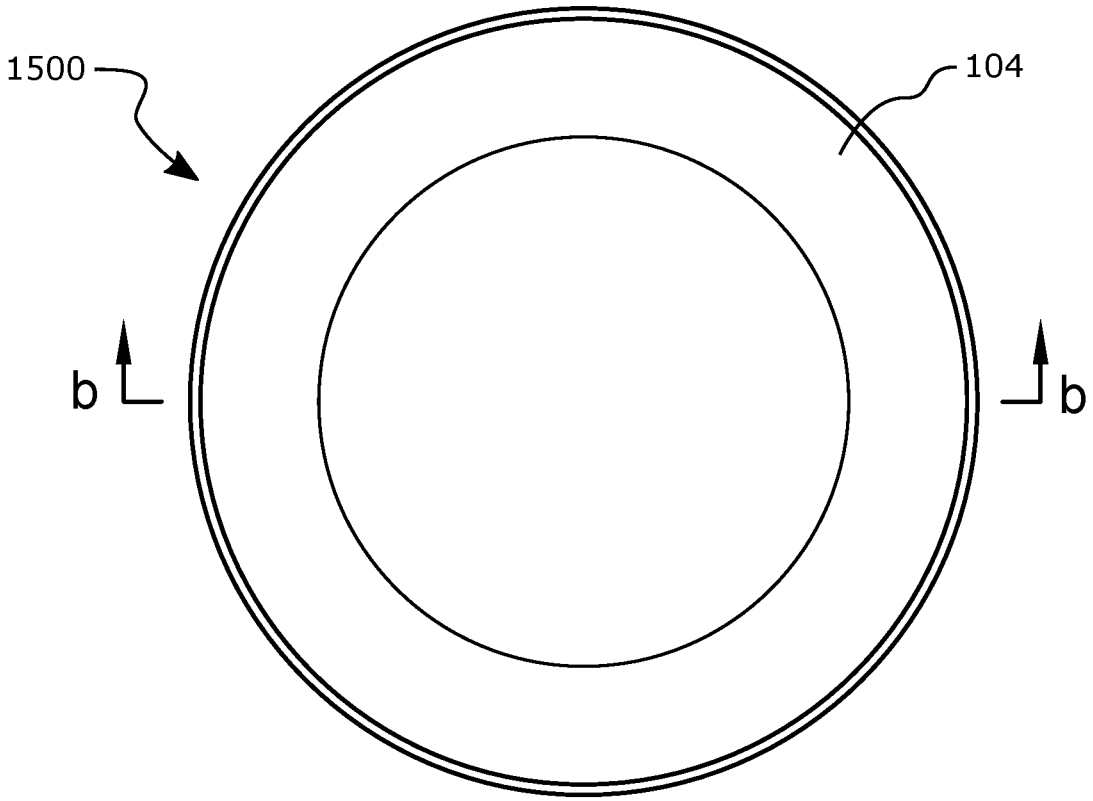
FIG. 17 shows a top view of a third embodiment and sectional line bb.
Figure 18:
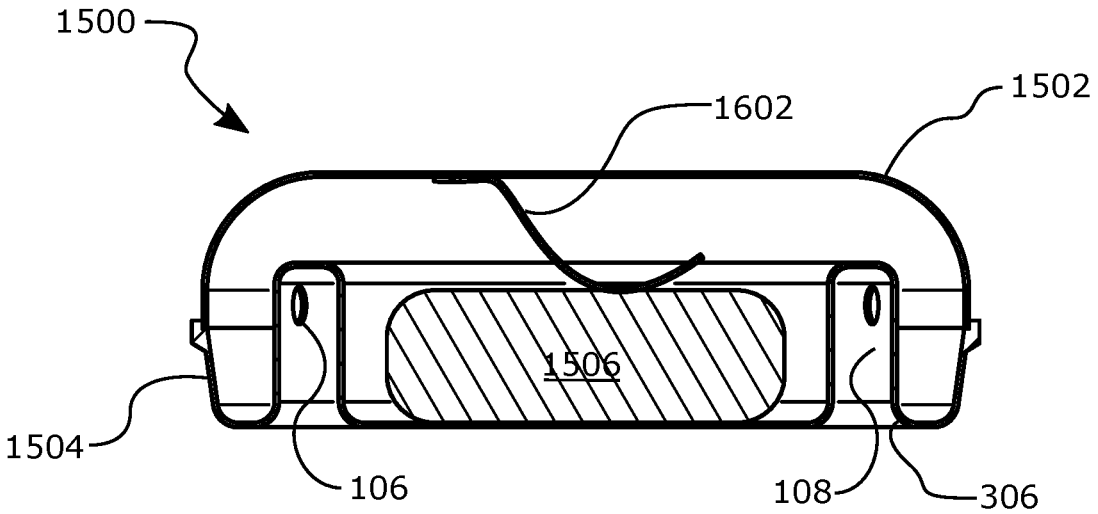
FIG. 18 is the cross-sectional view of section bb which includes a round bar of soap for reference.

Container 1500 shown in FIG. 15 illustrates another embodiment. FIG. 15 through FIG. 18 shows the construction of container 1500. The access cover 104 is sealed where it meets the body 102 by a snug; snap fit commonly used in other similar situations such as food storage containers. This embodiment differs from other embodiments discussed earlier in that there is one exterior opening 306 and one duct 108 and multiple interior openings 106. Additionally, this embodiment includes a commonly used method to retain the item inside by use of a spring-loaded retainer 1602. A round soap bar 1506 is included for reference.

Operation—Third Embodiment: FIG. 19-FIG. 24

Figure 19:
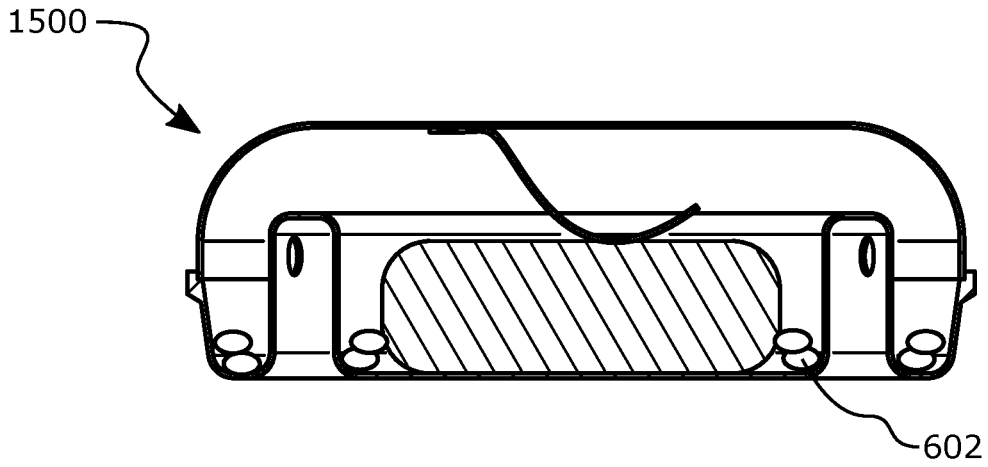
FIG. 19 is the same as FIG. 18 but with liquid droplets at 0 degrees.
Figure 20:
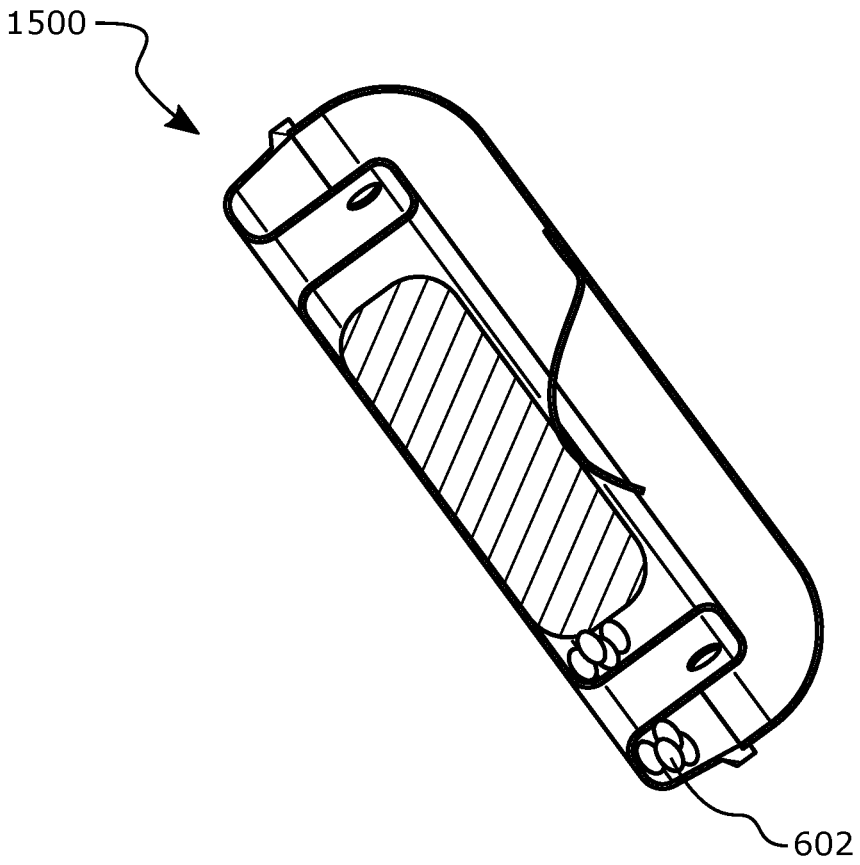
FIG. 20 is the same as FIG. 18 but tilted at 45 degrees.
Figure 21:
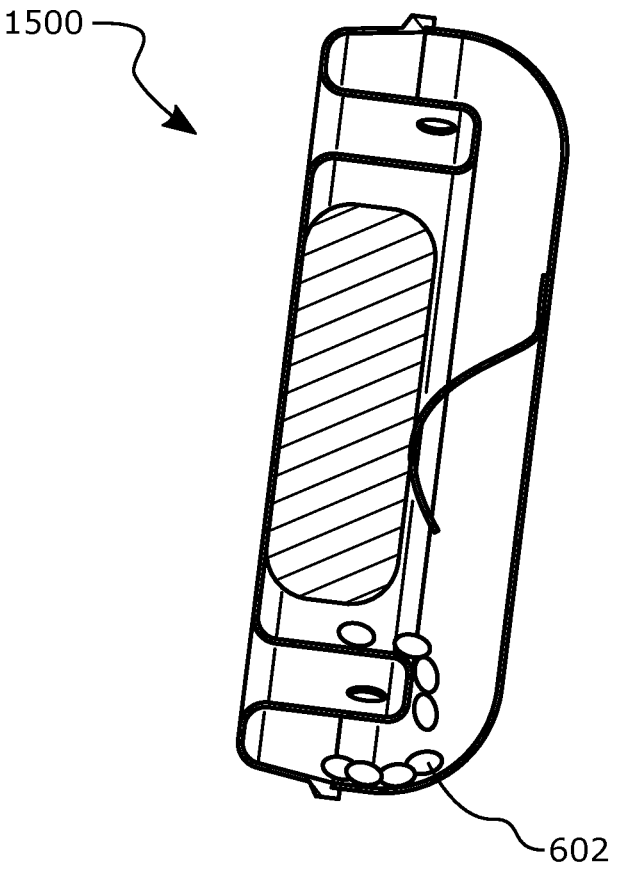
FIG. 21 is the same as FIG. 18 but tilted slightly over 90 degrees.
Figure 22:
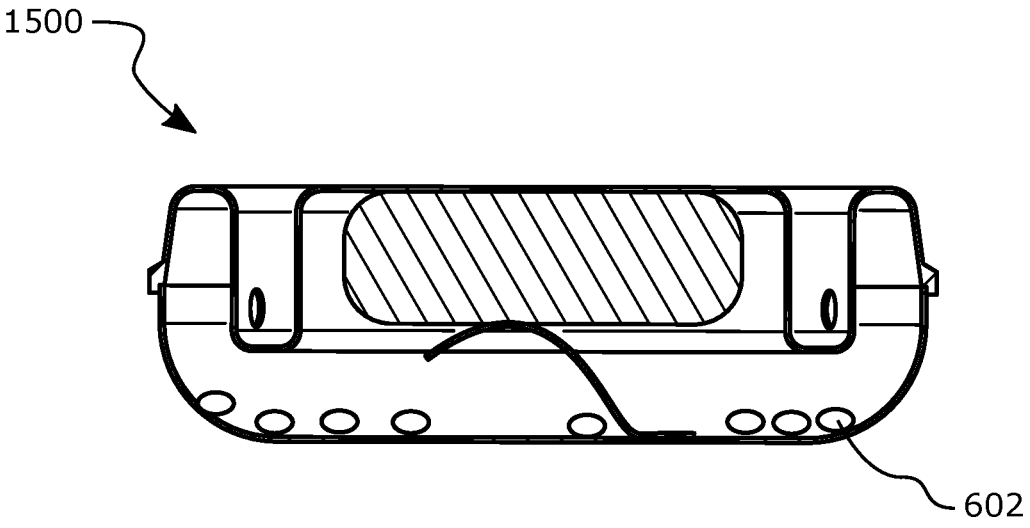
FIG. 22 is the same as FIG. 18 but tilted at 180 degrees.
Figure 23:
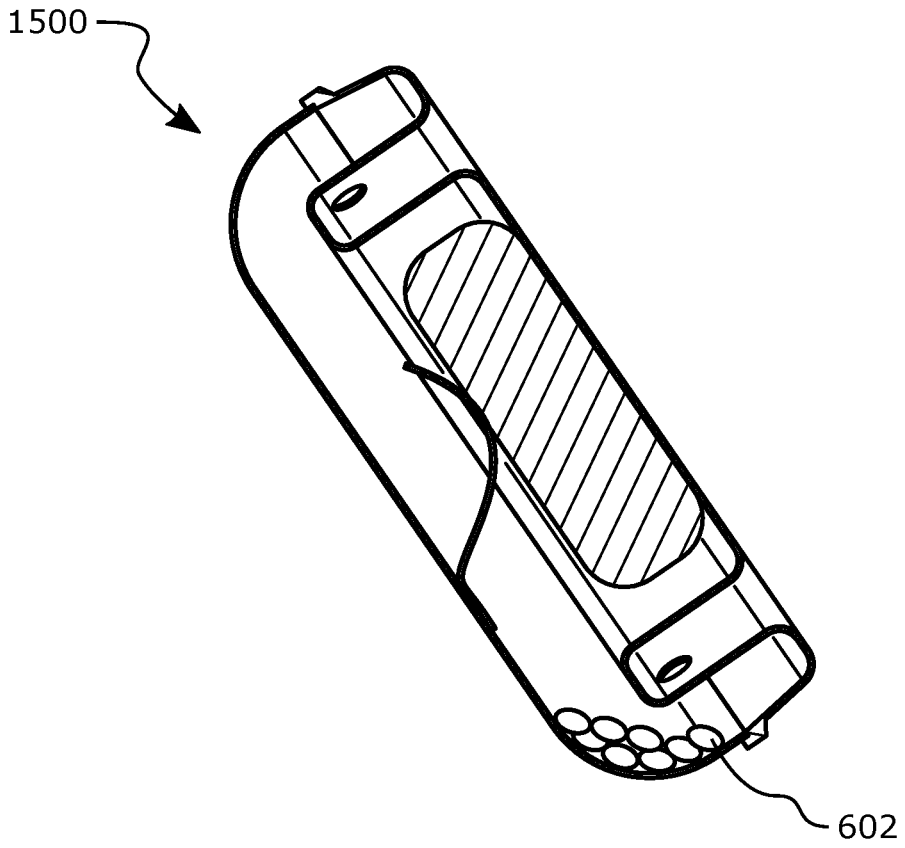
FIG. 23 is the same as FIG. 18 but tilted at 225 degrees.
Figure 24:
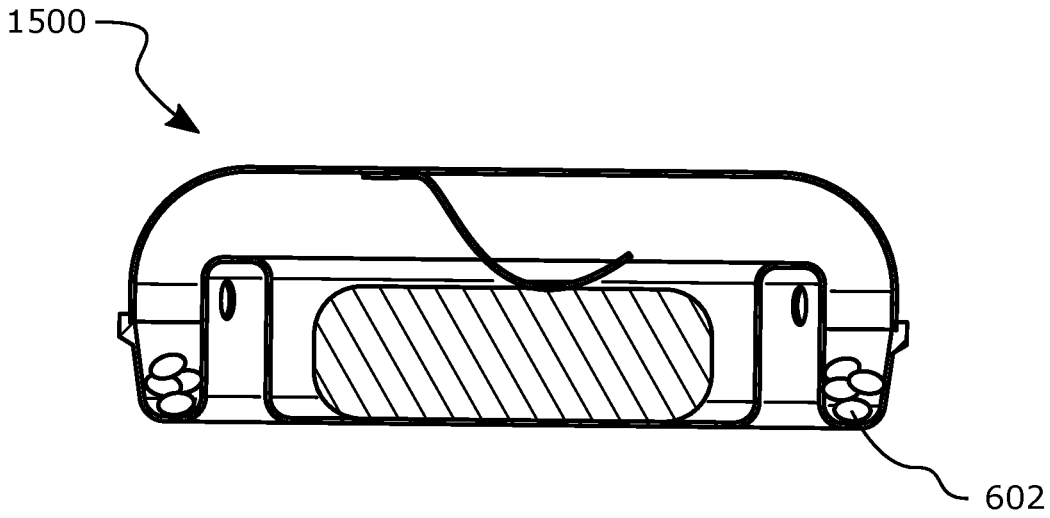
FIG. 24 is the same as FIG. 18 but tilted at 360 degrees.

An item is loaded into container 1500 by removing the access cover 104 from body 102 and placing the item inside the circular shaped duct 108 as illustrated in FIG. 19. The access cover 104 is then placed on to the body 102 and snapped into place. FIG. 19 through FIG. 24 illustrates where liquid 602 would gravitate to in various positions of container 1500. As in the other embodiments the liquid is directed away from the interior openings 106 thus preventing any leakage. It should also be noted that in this embodiment, the interior openings 106 are located on duct 108 on the opposite side of the item, in this case soap 1506. In this location, liquid 602 is diverted from interior openings 106 because the surface of duct 108 in this area is convex or out-curved. Placing interior openings 106 on the other side of duct 108 where duct 108 is concave or in-curved like a trough would provide a path for liquid 602 to traverse and leak out interior opening 106. It should also be noted that with this embodiment, liquid 602 on the soap bar 1506 side of the duct 108 will be directed to the other side of duct 108 after container 1500 is rotated 360 degrees and will not return back and will be trapped on the exterior side away from the item inside as shown in FIG. 24.

Advantages

From the description above, a number of advantages of some embodiments of my ventilated leak-proof container become evident:

(a) Provides a way for wet items in a portable container to be exposed to dry air to aid in drying the wet items.

(b) The amount of liquid generally associated with items that get wet during use such as bar soap, toothbrushes or razors is trapped in the container thus preventing liquid from leaking out and creating a mess.

(c) Common manufacturing methods and materials can be used therefore can be made for a similar cost to prior art but with better performance.

CONCLUSION, RAMIFICATIONS AND SCOPE

Accordingly, the reader will see that the ventilated leak-proof container of the various embodiments can be used to transport items that get wet during use, but unlike other prior art, allows the items to dry and also capture liquid from the items to prevent a messy situation.

Although the description above contains many specificities, these should not be construed as limiting the scope of the embodiments but as merely providing illustrations of some of the several embodiments. For example, the material used in construction could be any leak-proof material such as plastic, glass, metal, wood etc. The size of the container can be made suitable for the intended application. As seen from the embodiments described, the number and size of the openings and ducts can be sized and shaped to accommodate the intended item and amount of liquid to be captured and needed drying capability. The shape of the ducts, openings can be made to accommodate the item and used in retaining the item as needed. The container access could be accomplished by several commonly used means such as those illustrated in the description. However other means could be, but are not limited to a threaded cap, spring loaded lid or zippered cover.

Thus the scope of the embodiments should be determined by the appended claims and their legal equivalents, rather than by the examples given.

I claim:

1. An apparatus for holding wet items, comprising:

a container made of leak tight material with an internal volume enclosed by a container wall, said container is comprised of a body, an access cover, said container access cover is secured to said container body wherein the point at which said container access cover is secured to said container body is leak-proof, said container has at least one opening in said container wall, at least one duct with a predetermined cross-section, said duct extends from said container wall or some predetermined distance outside said container wall through said container opening terminating at some predetermined distance inside said container wherein the point at which said duct passes through said container opening is leak tight between said duct exterior and said container opening, said duct has at least one hole located at a predetermined distance from said container wall on the portion of said duct located inside said container wherein said inside hole is on a portion of said duct where the cross-section is flat or convex relative to said duct exterior, said duct has at least one hole located on the portion of said duct located on the outside of said container, whereby said container retains some amount of liquid from said wet items and exposes said container interior to exterior air.

2. The apparatus for holding wet items of claim 1, wherein said duct is placed in at least one location defined by the perimeter of said container intended contents, whereby retaining container contents.

3. The apparatus for holding wet items of claim 1, wherein said container is further comprised:

a spring-loaded retainer comprised of two ends, said spring-loaded retainer is compression in nature, said first end of said spring-loaded retainer is attached to the interior of said access cover, said second end of said spring-loaded retainer is positioned to intercept intended said container contents when said container access lid is secured to said container body, whereby said container contents are retained.

4. The apparatus for holding wet items of claim 1, wherein said container body bottom interior surface has peaks and valleys to form a space under said container contents.

* * * * *